United States Patent [19]

Kato et al.

[11] Patent Number: 4,640,261

[45] Date of Patent: Feb. 3, 1987

[54] CERAMIC BURNER PLATE FOR GAS COMBUSTION

[75] Inventors: Hiroyuki Kato; Toshifumi Yamana, both of Aichi, Japan

[73] Assignee: Rinnai Kabushiki Kaisha, Nagoya, Japan

[21] Appl. No.: 696,071

[22] Filed: Jan. 29, 1985

[30] Foreign Application Priority Data

Jan. 30, 1984 [JP] Japan ..... 59-13377

[51] Int. Cl.[4] ..... F24C 3/00

[52] U.S. Cl. ..... 126/39 J; 126/39 R; 126/39 E; 126/214 K; 126/214 A; 501/5; 501/141; 501/39

[58] Field of Search ..... 126/39 E, 39 R, 39 C, 126/39 D, 39 N, 39 J, 214 R, 214 A; 501/1, 5, 36, 39, 80–85, 141, 144

[56] References Cited

U.S. PATENT DOCUMENTS

| | | | |
|---|---|---|---|
| 2,673,808 | 3/1954 | Meth | 501/39 X |
| 3,082,100 | 3/1963 | Wolf et al. | 501/39 X |
| 4,164,933 | 8/1979 | Alosi | 126/450 X |
| 4,201,184 | 5/1980 | Scheidler et al. | 126/214 A X |
| 4,222,373 | 9/1980 | Davis | 126/450 X |
| 4,519,828 | 5/1985 | Beall et al. | 501/5 X |
| 4,525,518 | 6/1985 | Kostansek | 501/141 X |

*Primary Examiner*—Larry Jones

*Attorney, Agent, or Firm*—Leonard Bloom

[57] ABSTRACT

An improved ceramic burner plate for gas combustion which is made from a composition comprising about 30–40 weight percent of a clay, about 3–8 weight percent of talc, about 25–40 weight percent of a pore-producing substance and about 14–36 weight percent of mullite. The ceramic burner plates of the invention are characterized by excellent fire resistance and long service life.

5 Claims, No Drawings

CERAMIC BURNER PLATE FOR GAS COMBUSTION

FIELD OF THE INVENTION

This invention provides an improved ceramic burner plate for gas combustion. The burner plate is made from a novel composition which imparts excellent fire resistance and long service life.

BACKGROUND OF THE INVENTION

This invention relates to a ceramic burner plate for gas combustion which is in the form of a plate and is provided with a large number of flame openings passing therethrough from its front surface to its rear surface. Burner plates of this kind have hitherto been manufactured by baking a composition consisting of a particulate mixture comprising a clay, talc, a pore-producing substance and cordierite. Burner plates of this type are deficient in that they are so low in fire resistance that, if the temperature of the surface of the plate is brought to above about 950° C., there is an accelerated transformation in the crystal form of the composition to produce needle-like crystals. As a result, the surface presents a white, crumbly appearance in a short time. In addition, the flame openings become blocked with the needle-like crystals, resulting in incomplete combustion of gas. Service life is reduced. The foregoing exemplifies poor refractoriness.

SUMMARY OF THE INVENTION

The ceramic burner plate of this invention overcomes the deficiencies of the prior art and is characterized by excellent fire resistance, or good refractoriness. Refractoriness of a sample ceramic burner plate is determined by reducing a portion of the burner plate to a powder and determining by means of a thermo-balance any change in the weight of the sample as the temperature thereof is raised. Thereafter, the sample is checked by X-ray diffraction to determine whether or not there has been any crystal transformation. The temperature at which a change in weight and crystal transformation occur is defined as the refractoriness.

It is therefore an object of this invention to provide a ceramic burner plate for gas combustion which has excellent fire resistance, or good refractoriness.

It is yet another object of this invention to provide a ceramic burner plate for gas combustion which has an extended service life.

The foregoing and other objects are accomplished by the practice of this invention. Broadly, viewed in one of its principal aspects, this invention consists of a ceramic burner plate for gas combustion which is provided with a large number of flame openings passing therethrough between its front and rear surfaces and which is formed by molding a particulate composition into a plate shaped member and baking same, the improvement consisting of a particulate composition comprising about 33–40 weight percent of a clay, about 3–8 weight percent of talc, about 25–40 weight percent of a pore-producing substance, and about 14–36 weight percent of mullite.

The instant invention thus provides a ceramic burner plate for gas combustion which has excellent fire resistance and long service life. The ceramic burner plate of the invention is made from a composition comprising a novel combination of components.

The nature and substance of the present invention as well as its objects and advantages will be more clearly perceived and fully understood by referring to the following description and claims.

DESCRIPTION OF THE PREFERRED EMBODIMENTS

The improved ceramic burner plate for gas combustion of this invention is made from a composition comprising a novel combination of ingredients. The novel combination of ingredients comprises about 33–40 weight percent of a clay, about 3–8 weight percent of talc, about 25–40 weight percent of a pore-producing substance, and about 14–36 weight percent of mullite. The foregoing mixture is molded into a plate shaped member and then baked to thereby form the ceramic burner plate.

The clay which is one of the components of the foregoing mixture is a material for binding the other components together. Any kind of clay, such as ball clay, gairome clay, kaolin clay, kibushi clay or the like may be used. It is especially preferable to use a clay that is above SK 33 in refractoriness. It is critical that the amount of the clay in the mixture be within the range of about 33–40 weight percent. If the amount of clay is below about 33 weight percent, the mixture will have such poor cohesiveness that press molding will be impossible. If the amount of clay in the mixture is above about 40 weight percent, the mixture will be so sticky that it will adhere to the mold and, again, press molding will be impossible.

Talc is present in the mixture for the purpose of improving the slip property during press molding thereof. It is preferred that the mixture contain about 3–8 weight percent of talc. If the mixture contains less than about 3 weight percent of talc, the slip property of the mixture will be unacceptably poor. More than about 8 weight percent of talc in the mixture is unnecessary to achieve the desired slip property and, moreover, is uneconomical.

The pore producing substance is added to increase the porosity of the burner plate to thereby impart an adiabatic effect thereto. Any kind of coal, wood chips or the like that generates gasses during baking may be used. It is important that the amount of pore producing substance in the mixture prior to molding and baking be within the range of about 25–40 weight percent. If less than about 25 weight percent of pore producing substance is present in the mixture, the porosity of a burner plate made therefrom will be so poor that back-firing is liable to occur. If the amount of pore producing substance exceeds about 40 weight percent, the resulting ceramic burner plate will have unacceptably poor mechanical strength.

Mullite is present in the mixture for the purpose of enhancing the fire resistance of ceramic burner plates made therefrom. It is critical that the amount of mullite in the mixture be within the range of about 14–36 weight percent. If the amount of mullite in the mixture is below about 14 weight percent, a burner plate made therefrom will have inadequate fire resistance. If more than about 36 weight percent of mullite is present, a burner plate made from the mixture will exhibit such high thermal expansion properties that the capability for molding such a burner plate will be lowered.

The particulate composition used to make the ceramic burner plates of this invention may be granular or powdered. It is preferred that it be powered.

In manufacturing a ceramic burner plate in accordance with this invention, the particulate composition of the invention, with each component thereof preferably in powdered form, is mixed and kneaded to form a uniform, homogeneous mixture. The resultant mixture is molded, as by a press molding machine, into a plate shaped member having a large number of flame openings passing therethrough from its front surface to its rear surface. The molded plate shaped member is then dried and thereafter baked to produce a ceramic burner plate of this invention.

The following specific examples will serve to further illustrate the invention.

EXAMPLE 1

A mixture according to the invention, with each component in powdered form, was prepared with the following composition:

Ball clay: 40 wt. %
Talc: 6 wt. %
Coal: 40 wt. %
Mullite: 14 wt. %

This mixture was then mixed and kneaded together uniformly, and the resultant homogeneous composition was molded under pressure in a press molding machine. The resultant plate shaped member was baked at about 1000° C. to obtain a ceramic burner plate of this invention.

The refractoriness of the resultant ceramic burner plate was 1110° C., and even if its temperature was kept about 1100° C. for a long time, there was no substantial change in quality.

EXAMPLE 2

A ceramic burner plate of this invention was manufactured under the same conditions as in Example 1, except that the composition of the mixture was as follows:

Ball clay: 35 wt. %
Talc: 5 wt. %
Coal: 25 wt. %
Mullite: 35 wt. %

The refractoriness of the resultant ceramic burner plate was 1180° C., and even if its surface temperature was kept at about 1100° C. for a long time, there was no substantial change in quality.

EXAMPLE 3

For comparison purposes, a ceramic burner plate was manufactured under the same conditions as in Example 1, except that the mixture had the following composition:

Ball clay: 45 wt. %
Talc: 5 wt. %
Coal: 40 wt. %
Mullite: 10 wt. %

The refractoriness of the resultant ceramic burner plate was only about 1050° C., and if the surface temperature was kept at about 1100° C. for a long time, there resulted a slight deterioration in the quality. This example illustrates the loss of refractoriness when too little mullite is present in the composition.

EXAMPLE 4

For comparison purposes, a ceramic burner plate was manufactured under the same conditions as in Example 1, except that the mixture had the following composition:

Ball clay: 40 wt. %
Talc: 8 wt. %
Coal: 40 wt. %
Mullite: 12 wt. %

The refractoriness of the resultant ceramic burner plate was only about 1055° C., and if the surface temperature was kept at about 1100° C. for a long time, a slight deterioration in the quality resulted. This example illustrates the loss of refractoriness when the composition contains too little mullite.

Thus, the instant invention provides an improved ceramic burner plate for gas combustion. The ceramic burner plate of the invention exhibits a high level of refractoriness and is characterized by long service life. The ceramic burner plate is made from a novel particulate composition comprising about 33–40 weight percent of a clay, about 3–8 weight percent of talc, about 25–40 weight percent of a pore-producing substance, and about 14–36 weight percent of mullite. A homogeneous mixture having the foregoing composition is press molded and baked to give the improved ceramic burner plate of the invention.

While specific embodiments of the present invention have been shown and described in detail to illustrate the utilization of the inventive principles, it is to be understood that such showing and description have been offered only by way of example and not by way of limitation. Protection by Letters Patent of this invention in all its aspects as the same are set forth in the appended claims is sought to the broadest extent that the prior art allows.

We claim as our invention:

1. In a ceramic burner plate for gas combustion which is provided with a large number of flame openings passing therethrough between its front and rear surfaces and which is formed by molding a particulate composition into a plate shaped member and baking same, the improvement consisting of a particulate composition comprising about 33–40 weight percent of a clay, about 3–8 weight percent of talc, about 25–40 weight percent of a pore-producing substance, and about 14–36 weight percent of mullite.

2. The ceramic burner plate of claim 1 wherein the clay is selected from the group consisting of ball clay, gairome clay, kaolin and kibushi clay.

3. The ceramic burner plate of claim 1 wherein the pore-producing substance is selected from the group consisting of coal and wood chips.

4. The ceramic burner plate of claim 1 wherein said particulate composition comprises about 40 weight percent of a clay, about 6 weight percent of talc, about 40 weight percent of coal, and about 14 weight percent of mullite and wherein each of said components of the composition is in powdered form.

5. The ceramic burner plate of claim 1 wherein said particulate composition comprises about 35 weight percent of a clay, about 5 weight percent of talc, about 25 weight percent of coal, and about 35 weight percent of mullite and wherein each of said components of the composition is in powdered form.

* * * * *